US006443444B1

(12) United States Patent
Cera et al.

(10) Patent No.: US 6,443,444 B1
(45) Date of Patent: Sep. 3, 2002

(54) SINGULATION MECHANISM

(75) Inventors: George Cera, Endicott; Wayne Blackwell, Chenango Forks; Lou Taylor, Apalachin, all of NY (US)

(73) Assignee: Lockhead Martin Corporation, Bethesda, MD (US)

( * ) Notice: Subject to any disclaimer, the term of this patent is extended or adjusted under 35 U.S.C. 154(b) by 0 days.

(21) Appl. No.: 09/411,961

(22) Filed: Oct. 4, 1999

(51) Int. Cl.[7] ..... B65H 3/08

(52) U.S. Cl. ..... 271/108; 271/96; 271/258.01; 271/10.03

(58) Field of Search ..... 271/108, 96, 94, 271/35, 110, 112, 114, 258.01, 11, 10.03

(56) References Cited

U.S. PATENT DOCUMENTS

| | | | | |
|---|---|---|---|---|
| 2,837,333 A | * | 6/1958 | Sindzinski et al. | 271/96 |
| 2,970,834 A | * | 2/1961 | Martin et al. | 271/96 |
| 3,194,552 A | * | 7/1965 | Buchwald | 271/96 |
| 3,606,305 A | | 9/1971 | Debackere et al. | |
| 3,817,516 A | | 6/1974 | Lazzarotti et al. | |
| 4,357,007 A | * | 11/1982 | Mens Franciscus et al. | 271/96 |
| 4,421,306 A | * | 12/1983 | Muka | 271/108 |
| 4,523,753 A | | 6/1985 | Hiromori et al. | |
| 4,632,381 A | * | 12/1986 | Cuir et al. | 271/96 |
| 4,651,984 A | * | 3/1987 | Emrich | 271/96 |
| 5,139,253 A | * | 8/1992 | Bohme et al. | 271/197 |
| 5,290,022 A | | 3/1994 | Sabatier et al. | 271/12 |
| 5,391,051 A | * | 2/1995 | Sabatier et al. | 271/96 |
| 5,507,480 A | | 4/1996 | Martin et al. | |
| 5,697,606 A | * | 12/1997 | Maass | 271/197 |
| 5,704,607 A | * | 1/1998 | Brotherson | 271/108 |

FOREIGN PATENT DOCUMENTS

| | | |
|---|---|---|
| EP | 0018057 | 10/1980 |

* cited by examiner

*Primary Examiner*—Donald P. Walsh
*Assistant Examiner*—Jonathan R. Miller
(74) *Attorney, Agent, or Firm*—Wolf, Greenfield & Sacks, P.C.

(57) ABSTRACT

A singulation mechanism is provided for use in a handling system for mail or other substantially flat articles, the mechanism having a singulation head with a drive mechanism which, in accordance with a first aspect of the invention, initially moves an article pressed thereagainst with high acceleration, interrupts the drive to the article for a brief instant and then moves the article again at high acceleration, a take-away mechanism removing the article exiting the head. In accordance with a second aspect of the invention, movement at a high acceleration is imparted to the article pressed against the singulation head only when the head is energized and substantially no movement in imparted when the head is not energized. More specifically, the singulation head may include a belt driven over a pair of vacuum chambers, with the trailing vacuum chamber being initially energized to draw the article against the bell and move the article with high acceleration to a position detected by a first detector, at which time the trailing vacuum chamber is turned off and the leading vacuum chamber turned on to again grab the article and move it to the take-away mechanism with high acceleration. This two-step acceleration process is effective for shaking free doubles from the article being singulated. The belt has a substantially friction-free surface in contact with the article to assure that movement is imparted to the article only when a vacuum chamber is turned on. The mechanism includes additional features, including a doubles resolver head, for preventing the passage of doubles to the take mechanism.

20 Claims, 4 Drawing Sheets

SINGULATION MECHANISM

FIELD OF THE INVENTION

This invention relates to handling and processing systems for mixed mail and related articles, and more particularly to a singulation mechanism for use in such systems which facilitate the handling of articles having significant variation in size, thickness and weight.

BACKGROUND OF THE INVENTION

Mixed mail received at a post office or other location must be sorted and/or otherwise processed so as to be directable to a desired location. To accomplish this function, random items of incoming mail are typically stacked, either manually or otherwise, for feeding to a first mechanism which singulates the mail so that only a single piece of such mail, which is properly oriented and spaced, is passed on to the sorting or other processing mechanism of a mail handling system.

While many mechanisms currently on the market do an adequate job of singulating certain types of mail, increasing demands are being placed on such systems, both as to the ranges in size, thickness and weight of the mail pieces to be handled and as to the speed at which such systems are to operate, while still maintaining high controllability on the outputted mail pieces, a low jam rate, low damage rate and substantial elimination of doubles passing into the sorting mechanism. For example, a specification for mail pieces to be handled in such a high performance system might include pieces ranging in thickness from 0.007" to 1.25", pieces ranging in weight from 0.03 oz to 6.0 lbs., and pieces ranging in size from 3.5"×5.0" or 4.0"×4.0" to 15"×15". These variations in thickness, weight and size must be handled without sacrificing throughput, which may be up to approximately 14,500 mail pieces per hour, although this maximum rate may vary somewhat with the size of the pieces being processed, and preferably with an ability to control this rate. A system capable of reliably achieving this level of performance without jams and other problems does not currently exist. Further, while the requirements discussed above are particularly applicable to mail handling systems, they can also arise in handling systems for packages and/or other generally flat articles.

SUMMARY OF THE INVENTION

In accordance with the above, this invention provides a singulation mechanism for use in a handling system for mail or other substantially flat articles. Mail/articles are fed, for example by a suitable feed mechanism, from a stack to a singulation head, the first piece of mail/article being preferably pressed from the stack against the head. In the broader sense and in accordance with a first aspect of the inventions, the singulation head includes a drive mechanism which initially moves a piece of mail or other article pressed thereagainst with high acceleration, interrupts the drive to the piece mail/article for a brief instant, and then moves the piece of mail/article again at high acceleration, a take-away mechanism removing mail/articles exiting the head. At least one position detector may be provided for articles moved by the head, drive interrupt and restart at the head being in response to a selected position detection by such detector. The drive mechanism may include a plurality of drive components, including at least a first rear component and a second forward component, the first component being initially energized to move the article, then de-energized to interrupt drive and the second component then being energized to move the article again. The drive mechanism may include a drive belt moving at a selected rate across the head, and the first and second components may be components selectively applying vacuum pressure through an adjacent portion of the belt. Where a doubled piece of mail may be hung up between the singulation head and the take-away mechanism, a detector may be provided which detects the presence of a piece of mail in between the head and take-away mechanism, and a control may be provided which is operative in response to an output from the detector, after detection that a piece of mail being singulated has reached a predetermined position in the take-away mechanism, for energizing the second component to move the doubled piece to the take-away mechanism.

More specifically, the singulation head to which a stack of mail/articles is fed may include a belt having a predetermined pattern of openings formed therein, which belt is driven across the head at a selected rate, and first and second vacuum chambers positioned behind the belt so as to apply vacuum therethrough when energized, the first vacuum chamber V1 trailing the second vacuum chamber V2, the belt therefore passing over V1 before V2. An article fed to the head is pressed against a surface of the belt opposite that passing over V1 and V2. A first detector is provided for detecting when an article being singulated by the head reaches a selected first point near a leading edge of the head. A take-away mechanism is provided for articles exiting the head and a second detector is provided for detecting the articles reaching a selected second point of the take-away mechanism. Controls are also provided for selectively energizing V1, for de-energizing V1 and energizing V2 in response to an output from the first detector and for de-energizing V2 in response to an output from the second detector.

The vacuum chambers when energized are preferably at a vacuum pressure of approximately 10 Hg to 25 Hg. For applications such as mail handling, the vacuum pressure depends at least in part on the selected weight range for the articles. Where the articles have a maximum weight of approximately 6 lbs., the vacuum pressure range is approximately 15 Hg to 24 Hg. The vacuum flow for the vacuum chamber is preferably in a range of approximately 14 cfm to 17 cfm. For an alternative embodiment, the controls also momentarily stop and restart the belt in response to an output from the first detector. The surface of the belt against which articles are pressed preferably has a low coefficient of friction, being substantially friction free, whereby, absent vacuum applied through the belt from a vacuum chamber, the belt does not impart substantial movement to an article pressed against it. The head preferably has at least one pressure sensor to detect the pressure at which articles are pressed against the surface of the belt, there preferably being a pressure sensor below the belt and at least one pressure sensor above the belt. There is also preferably at least one low pressure vacuum chamber trailing the belt to apply drag force to doubles and at least one low pressure vacuum chamber above and below the belt to stabilize articles and to further apply drag forces to doubles. A doubles resolver head may also be provided between the singulation head and the take-away mechanism to further assure against doubles reaching the take-away mechanism. For singulation of mail, the belt for the singulation head preferably operates at 78 to 85 in/sec and the take-away mechanism preferably operates at approximately 100 to 102 in/sec.

In accordance with a second aspect of the invention, the singulation head includes a drive mechanism which, when energized, moves a first article in a stack to be singulated at high acceleration and, when not energized, imparts substantially no movement to the article and a control for energizing the mechanism only when the first article is to be moved. For a preferred embodiment, the head includes a belt having a predetermined pattern of openings formed therein, which belt is driven across the head at a selected rate. The belt has a first side with a substantially friction-free surface against which the articles are pressed and a second side which is opposite the first side. A source selectively applies low pressure to the second side of the belt when an article is to be moved by the belt, the belt being substantially ineffective to move an article pressed against the friction-free surface thereof when low pressure is not applied to the belt. For preferred embodiments, the low pressure is a vacuum pressure and at least the friction-free surface of the belt is of a substantially friction-free material. Where the head is being used to singulate mixed mail, the belt is preferable approximately 3" wide and continuously perforated.

The invention also includes a belt for use in a singulation head of a substantially flat article handling system, which belt includes a first side having a substantially friction-free surface against which the article is pressed and a second side opposite the first side to which the head selectively applies at least substantial vacuum pressure. A pattern of openings is formed in the belt between its first and second sides. Where the belt is being used for the singulation of mixed mail, the belt may for example be approximately 3" wide and continuously perforated.

The foregoing and other objects, features and advantages of the invention will be apparent from the following more particular description of preferred embodiments of the invention as illustrated in the accompanying drawings.

IN THE DRAWINGS

DETAILED DESCRIPTION

Figure 1:
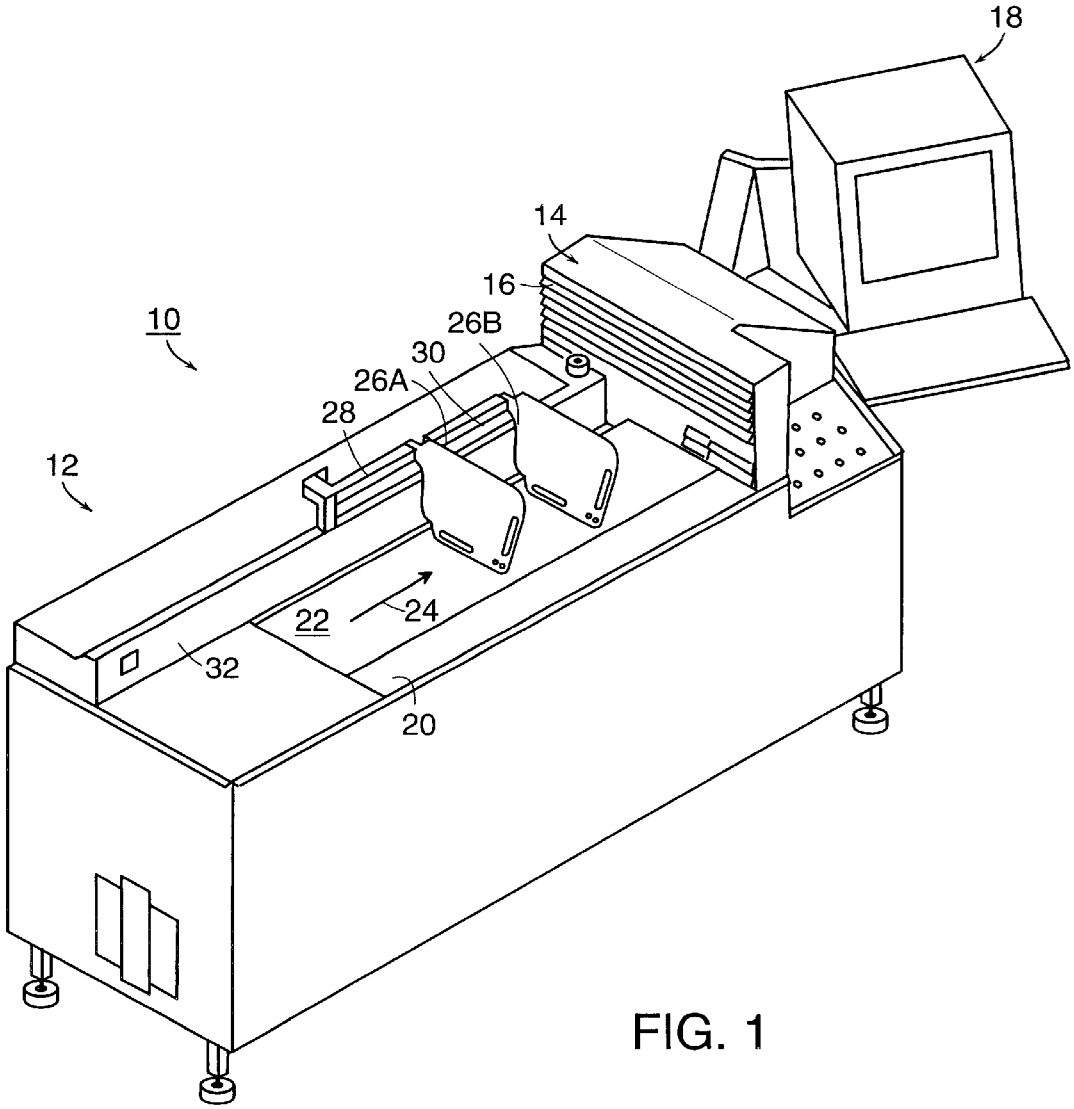
FIG. 1 is a perspective view of a mixed mail feeder machine of a type suitable for use in practicing the teachings of this invention.

FIG. 1 illustrates a mixed mail feeding machine 10 which consists of a mail feed section 12, a singulation head 14, a take-away mechanism 16, and a control computer 18. While computer 18 for the illustrative embodiment is shown at machine 10 and as having a keyboard and a monitor, the control computer need not be located at machine 10; for example several machines 10 could be controlled by a single separately located computer, or only a slave control could be located at the machine without input or output devices, the slave interfacing with a master computer. Feeding mechanism 12 may be any of a variety of mechanisms suitable for delivering a stack of mixed mail under controlled pressure to singulation head 14. The illustrative mechanism shown in FIG. 1 includes a stacking table 20 having a rotating belt 22 mounted thereon, belt 22 being driven in direction 24 by a suitable drive mechanism (not shown). The drive mechanism for belt 22 could for example include a roller at each end of the belt, at least one of which rollers is driven by a servo motor under control of computer 18. A pair of paddles or plates 26A, 26B extend upward substantially perpendicular to belt 22 and are each attached to a corresponding arm 28A, 28B fixed to the housing of feed mechanism 12 in a manner so that they may be pivoted away from belt 22. A separate drive mechanisms 30, which may for example, be driven by a worm gears rotated by a servo motor operating under control of computer 18, controls the movement of plates 26, and in particular the pressure applied by the plates to mail stacked between the plates and singulation head 14. The movements of belt 22 and of plates 26 are independent, but are coordinated by processor 18. In some applications, the surface of table 20 may be of a low friction material, and belt 22 not used. However, the configuration shown is preferable. An indexing wall 32 is provided on the leading edge side of table 20.

Figure 2:
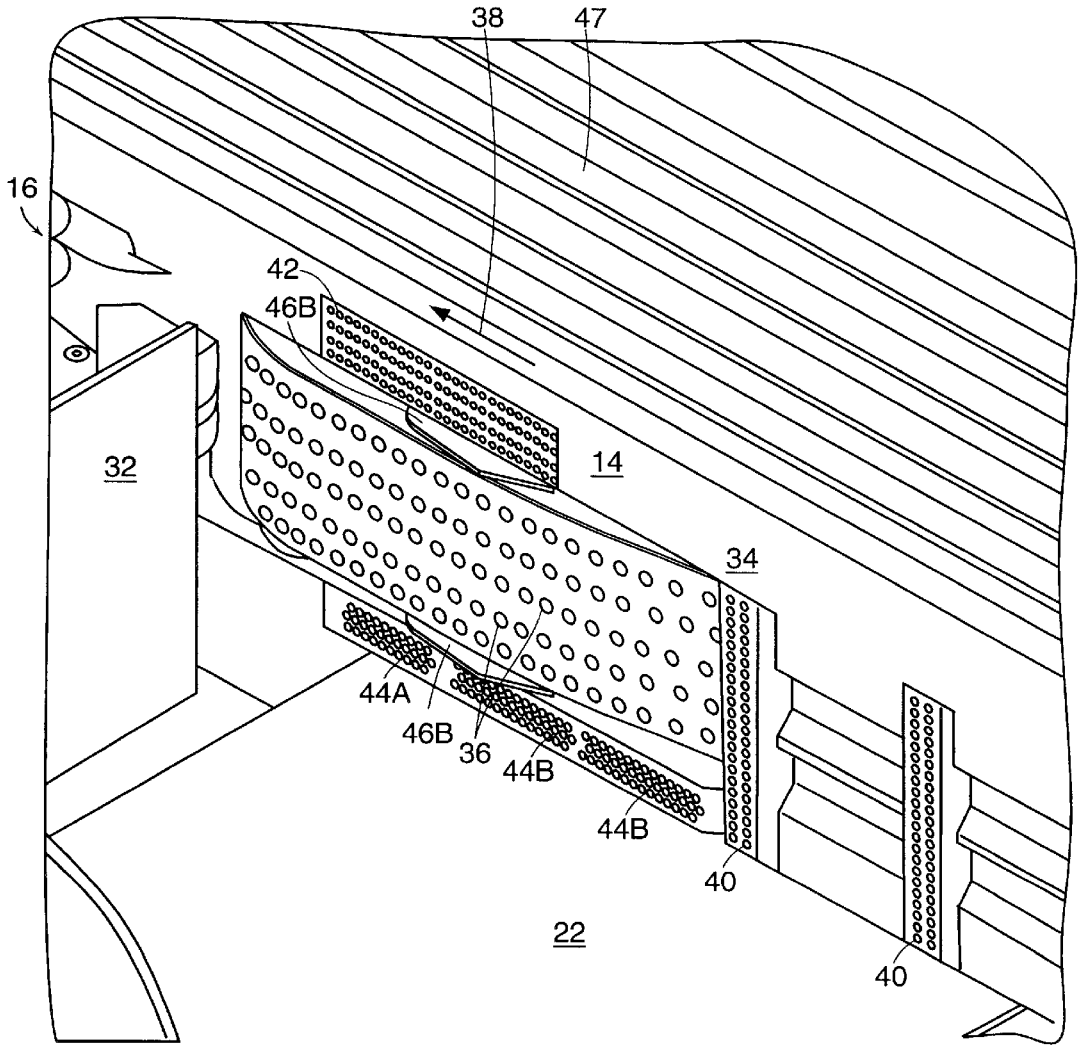
FIG. 2 is an enlarged perspective view of the front face of the singulation head for the machine shown in FIG. 1, this singulation head being a currently preferred embodiment of the invention.

FIG. 2 is an enlarged and more detailed view of singulation head 14 for a currently-preferred embodiment. The head includes a belt 34 of at least a low coefficient of friction material and preferably a nearly friction-free material (or at least having a low coefficient of friction/substantially friction-free outer, mail-contacting surface) having perforations 36 formed therein, the belt being moved in the direction of arrow 38. Belt 34 may for example have an outer layer or coating with a lacquered urethane finish. While the inner layer may be of a variety of materials, it is preferable, for reasons discussed later, that this layer also be of a low or non-friction material, for example a fine napped polyester belt, and the entire belt 34 may be formed in one piece of such material The entire belt or outer layer may also be a commercially available Teflon™ synthetic resin polymer impregnated belt. For a mixed mail application, the belt may for example be 3" wide. Singulation head 14 also has a pair of vacuum heads 40 on the rear or trailing side of belt 34, a vacuum head 42 above belt 34 and two vacuum chambers 44A, 44B below the belt. Head 14 also has a top pressure sensor 46T and a bottom pressure sensor 46B which determine the pressure at which a mail stack is pressed against belt 34. In particular, lower sensor 46B determines stack pressure, while upper or top sensor 46T provides an indication as to whether the mail is in the correct vertical plane (i.e., substantially parallel to belt 34) or whether uneven pressure is being applied across the mail in the vertical direction (normally greater pressure at the bottom and less pressure at the top) so that the lead mail piece may be slightly angled away from the belt in the vertical direction. If this condition is detected, control computer 18 can control either the drive for belt 22 or the drive 30 for the plate 26 being utilized so as to correct the problem, for example slowing or stopping belt 22 to reduce pressure at the bottom of the stack and/or applying greater force to the forward plate 26B. Finally, plate 47 above the singulation head is ridged or waffled so as to have less surface area in contact with mail pieces passing thereacross, and thus less friction with the mall pieces. This results in less potential damage to the mail and in easier and more efficient pick-off of mail from the head.

Figure 3:
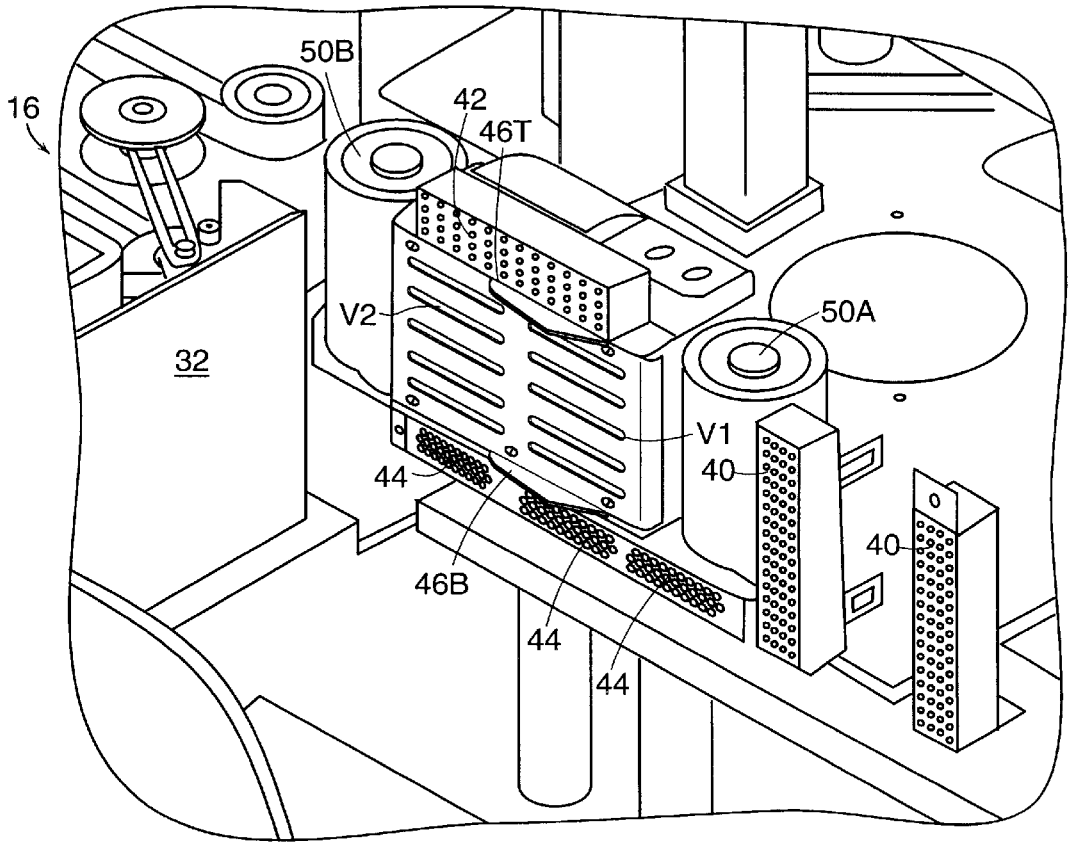
FIG. 3 is a perspective view similar to that of FIG. 2, showing the head with the belts and covers removed.

Referring to FIG. 3, it is seen that for a preferred embodiment a pair of vacuum chambers V1 and V2 are positioned behind belt 34. These chambers provide high flow, medium pressure vacuum to engage mail pieces through perforations or holes 36 in belt 34. The medium volume vacuum needs to be strong enough so as to be able to move the maximum weight of mail for which the machine 10 is designed, but not so strong as to damage mail or to aggravate a doubles problem where the piece of mail being moved is relatively thin and potentially porous. Where the maximum weight of mail being handled is approximately 6 pounds, a vacuum pressure of approximately 15 to 24 Hg (inches of mercury) was found suitable for chambers V1 and V2 for an illustrative embodiment, a pressure range of 10 to 25 Hg covering most intended applications of the invention for mail handling. High air flow is required in order to rapidly acquire a piece of mail, for example in a quarter of a second or less, to achieve the desired rapid acceleration. However, high air flow can also cause a doubles problem through thin and relatively porous mail. For the weights, thicknesses and size of mail previously discussed, an air flow for vacuum chambers V1 and V2 of approximately 14 cfm to 17 cfm has been found suitable for an illustrative embodiment.

Figure 4:
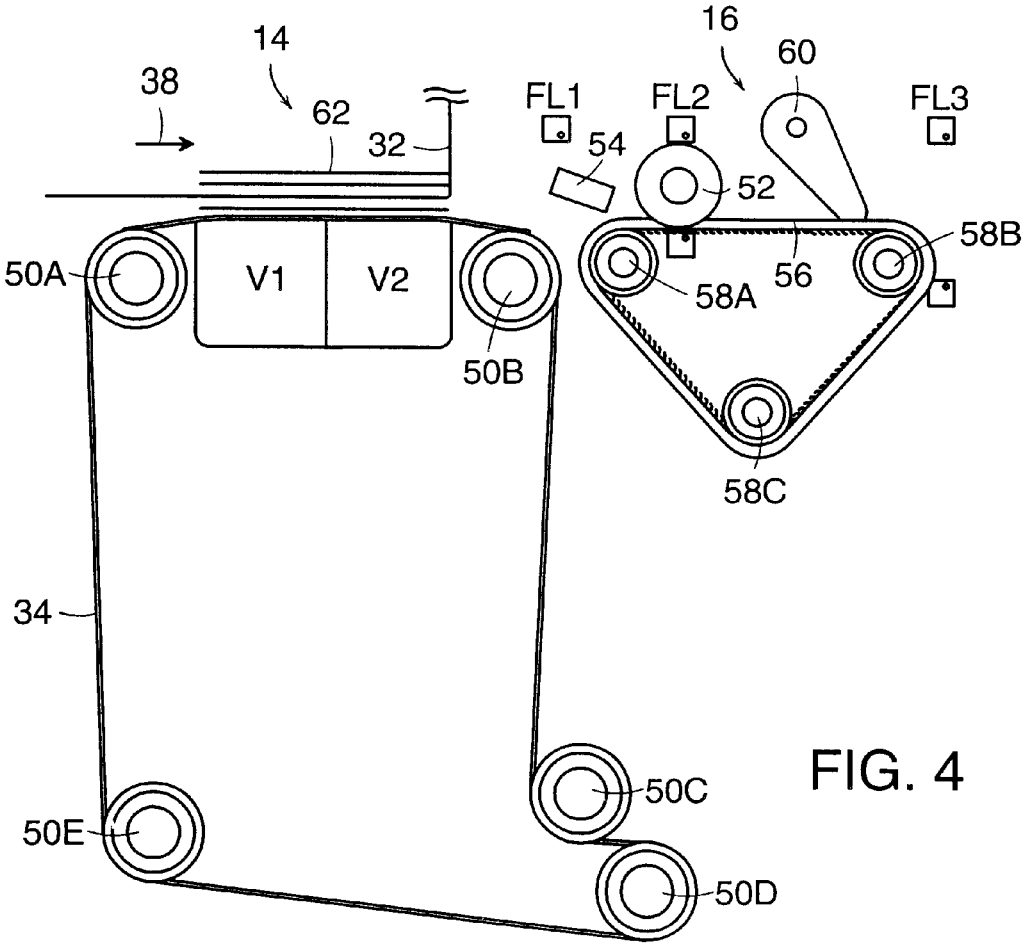
FIG. 4 is a graphic top view representation of a singulation head, doubles resolver head and take-away mechanism suitable for use in practicing the teachings of this invention.

FIG. 3 also shows two of the rollers 50A, 50B over which belt 34 passes. FIG. 4 shows all FIG. 3 also shows two of the rollers 50A, 50B over which belt 34 passes. FIG. 4 shows all five rollers 50A–50E used for belt 34, one of the rollers, roller 50D for a preferred embodiment, being the drive roller which is driven by, for example, a servo motor under control of processor 18. Roller 50D is preferred as the drive roller since it pulls the belt across singulation head 14, it being preferable to pull rather then push the belt. FIG. 4 also shows three detectors FL1, FL2 and FL3, which are preferably photodetectors and which detect a mail piece at the leading end of singulation head 14 under a doubles resolver head 54, at a trailing-end pressure roller 52 of take-away mechanism 16 and at the leading end of take-away mechanism 16, respectively. Vacuum doubles resolver head 54 is also shown positioned over mail pieces as they leave singulation head 14. This head, which has ½ to ⅓ the vacuum pressure of chambers V1 and V2, is utilized to retard any doubles piece of mail still attached to a piece of mail being fed at this point, thereby stripping such double from the piece of mail being fed so that only a single piece of mail reaches take-away mechanism 16. Takeaway mechanism 16, which is described in detail in co-pending application Ser. No. 09/410,940 filed concurrent herewith, includes a belt (or belts) 56, which is preferably a timing belt having a high coefficient of friction surface in contact with the mail pieces. Belt(s) 56 is driven by three rollers 58A–58C, one of which, for example roller 58A, is driven by a servo motor under control of processor 18. In addition to pinch rollers 52 near the trailing side of take-away mechanism 16, a plurality, for example two, fingers 60 are provided which are independently biased into contact with mail pieces passing over belts 56.

In operation, a person normally places a stack of mail between the forward one of plates 26, plate 26B, and singulation head 14, with the leading edge of the mail pieces 62 aligned against wall 32 as shown for example in FIG. 4. An additional stack of mail may be placed between plates 26A and 26B. In a mixed mail application, the pieces of mail in a given stack will be of random size, thickness and weight. To the extent the stack includes magazines or similar mail bound on one side and open on the other, such mail should be stacked bound-side down to enhance handling during singulation and minimize damage. Once the mail is stacked, belt 22 is operated to move the stack or stacks of mail against singulation head 14 and drive (or drives) 30 is similarly activated to move plates 26 in direction 22. These movements are controlled by processor 18 so as to deliver the mail stack to singulation head 14 under a predetermined pressure, which pressure is substantially uniform over the face of the singulation head. Any variation in pressure between the top and bottom of the singulation head, which variation is detected by detectors 46T and 46B, is compensated for by the drives for belt 22 and plates 26 under control of processor 18 in the manner previously described.

Figure 5:
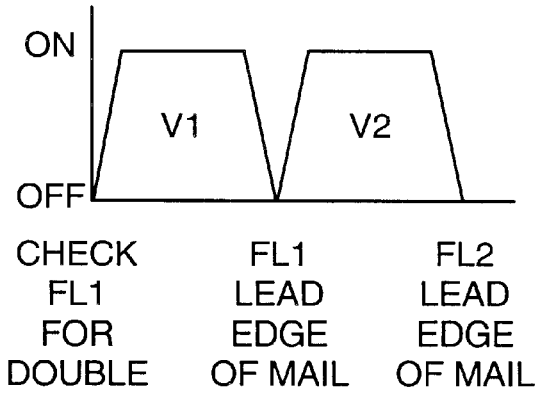
FIG. 5 is a diagram illustrating an acceleration/deceleration profile for mail under the influence of vacuum chambers V1, V2 of FIG. 4 for an exemplary implementation of the invention.

Since the surface of belt 34 is of a substantially friction-free material, mail 62 pressed thereagainst is not moved by the belt until vacuum is applied to either one or both of vacuum chambers V1, V2. The rear of belt 34 also being of a substantially friction-free material for preferred embodiments facilitates movement of the belt over the vacuum, chambers, reducing friction and thus heating at the head and belt wear, and also reducing the energy required to drive the belt. As shown in FIG. 5, when pressure detectors 46 determine that mail is in position at singulation head 14, processor 18 initially energizes vacuum chamber V1, causing apiece of mail 62 adjacent belt 34 to be grabbed by the belt and rapidly accelerated with ajerking action in direction 38. This jerking action at high acceleration tends to shear the piece of mail being moved from the next piece in the stack, minimizing doubles movement. As may be seen in FIG. 4, wall 32 is also spaced from belt 34 by a distance slightly greater than the maximum thickness of a piece of mail to be handled. This further reduces the likelihood of doubles passing to the take-away mechanism; however, since most mail is substantially thinner than the maximum allowed width, wall 32 alone is not sufficient to resolve the doubles problem.

Once the piece of mail in contact with belt 34 has been advanced to detector FL1, a distance of approximately 2 inches for an illustrative embodiment, the output signal from FL1 resulting from the detection of the leading edge of the piece of mail causes processor 18 to turn off the vacuum for chamber V1, which results in a momentary deceleration of the piece of mail. As shown in FIG. 5, as vacuum chamber V1 is deactivated, vacuum chamber V2 is activated to grab the piece of mail closer to its leading edge and again rapidly accelerate it toward take-away mechanism 16. This cycle of rapid acceleration, deceleration, and then rapid acceleration again, has been found to be effective for shaking free any doubles which might adhere to a piece of mail being fed, significantly reducing the incidence of such doubles. Vacuum chamber V2 remains on until the piece of mail reaches detector FL2, meaning that the piece of mail has now been grabbed by the take-away mechanism. An output signal from FL2, indicating that the leading edge of the piece of mail has reached pinch roller 52 of take-away mechanism 16, results in processor 18 turning off vacuum chamber V2 so that the chamber does not feed the next piece of mail. For an embodiment where the length of the smallest piece of mail being handled is 5 inches, the space between the leading edge of chamber V2, (i.e., wall 32) and the center of pinch rollers 52 is roughly 4 ⅓ inches. This assures that a piece of mail is powered from singulation head 14 to take-away mechanism 16 and does not get hung up therebetween.

To this point, two mechanisms have been discussed for eliminating undesired doubles which can cause jamming of the machine, these mechanisms being the acceleration profile of FIG. 5, which tends to shake any doubles free from the piece of mail being fed, and wall 32 which is effective to remove a double where either one or both of the pieces of mail are relatively thick. However, the system shown in the Figures has several additional mechanisms for resolving doubles. First, vacuum resolver head 54 will retard any double which reaches that point in the machine. The vacuum pressure on resolver head 54 is a fraction of the pressure for chamber V1 and V2, for example ⅓ to ½ the vacuum pressure for V1/V2, so that this head does not interfere or retard the passage of the desired piece of mail through the system.

However, since vacuum chamber V2 turns off once the piece of mail being passed through the system reaches FL2, any double resolved by resolver head 54 can get caught up in the space between singulation head 14 and take-away mechanism 16. This can cause a jam when the next piece of mail is fed. To eliminate this problem, when detector FL3 detects that a piece of mail has left take-away mechanism 16, it checks to see if there is still a piece of mail under detector FL1. If there is still a piece of mail under detector FL1 at this time, it means that a resolved double is stuck in this region. However, since as previously indicated, the spacing between the end of vacuum chamber V2 and take-away roller 52 is less than the length of the shortest piece of mail being processed, this also means that at least part of this resolved double is still over vacuum chamber V2. Processor 18 therefore turns off vacuum on resolver head 54 and turns on chamber V2 until the leading edge of this resolved piece of mail is detected at detector FL2 where it may be taken away by take-away mechanism 16. Vacuum chamber V2 is then turned off. For a preferred embodiment, vacuum from resolver head 54, instead of being turned off, is diverted to chamber 44*b*, this further retarding any additional double, particularly when the original double being cleared is a small piece of mail. Since belt 56 is moved at a higher speed than belt 34, for example 15% to 20% faster, take-away mechanism 16 can clear the double without substantially slowing down the singulation heads operation. For one illustrative embodiment, the ratio of belt 56 to belt 34 is 102 in/sec to 78.54 in/sec; however, near optimum results in terms of doubles resolving, damage control, etc. in a mail application were found to be approximately 100 in/sec for belt 56 and approximately 85 in/sec for belt 34. Vacuum chamber V1 may be turned on again once processor 18 receives an indication that the trailing edge of the doubled piece of mail has cleared detector FL1.

Heads 40 also hold onto the trailing side of the next piece of mail in the stack behind the piece being fed to retard this piece of mail from being doubled and vacuum heads 42 and 44 perform a similar function on the next piece of mail to be fed as they are uncovered during movement of the piece of mail being fed. Vacuum heads 42 and 44 also hold the piece of mail being fed in alignment, preventing skewing thereof as it is being fed, so that the piece of mail reaches take-away mechanism 16 in proper alignment.

For magazine or similar mail bound on one side, which as indicated earlier is the bottom side of such mail as stacked, both singulation head 14 and take-away mechanism 16 are dimensioned and to engage tie lower, more robust portion of such mail, thereby enhancing handling and reducing damage thereof. Such engagement may, for example, be only on the lower 3" of such mail for an illustrative embodiment.

While the invention has been described above with reference to a preferred embodiment, what is important in accordance with a first aspect of the invention is that the acceleration profile of FIG. 5 be imparted to the piece of mail being fed, namely an initial high acceleration movement followed by a short interval of no acceleration and ending with a second high acceleration movement to shake free any doubles. While the specific mechanism involving vacuum chambers V1 and V2 operated as indicated above is the currently preferred mechanism for achieving this profile, other ways for achieving the profile are also within the contemplation of the invention. For example, belt 34 may be started initially, stopped momentarily when the leading edge of the piece of mail being fed reaches FL1 and then rapidly restarted, this being done either instead of having two separate vacuum chambers V1, V2 operated as indicated, or in addition to having the two vacuum chambers operated as indicated. However, this technique does not seem to provide as good a result as using the two vacuum chambers alone. Using a single vacuum chamber which is turned on and turned off rather than two separate vacuum chambers as shown is another option which, while operationally simpler, is considered less effective since it tends to also move the next piece of mail in the stack as well as the piece of mail being fed.

In accordance with another expect of the invention, what is important is that mail or other article being moved be moved at high acceleration to shear it from doubles when movement is desired and that there be substantially no movement of the article when movement is not desired. This is accomplished for preferred embodiments by belt 34 being of a substantially frictionless material, or at least that the surface thereof incontact with the mail be of such a material. One problem with prior art singulation devices using a belt is that any time a mail piece comes in contact with the belt, it gets picked off. This is major cause of undesirable doubles. A second major problem is that movement of mail pieces in uncontrollable and somewhat unpredictable in that, since the motion is caused by friction, some motion can occur any time there is contact of mail piece with the belt, even when such motion is not desired. This lack of control also makes it vary difficult to achieve the high acceleration discussed earlier which provides a sheering effect between the piece of mail being delivered and the next following piece, even in the absence of the FIG. 5 double profile. Thus, even which a single vacuum chamber is being used, greater control is provided with a substantially friction-free belt so that feed can be made on demand, the rate at which mail pieces are fed can be controlled, the pitch and gap of the mail stream can be better controlled and the pressure of the mail stacked against the singulation head can be better controlled without worrying about doubles due to friction feed, thereby enhancing the ability to singulate from the stack. Therefore, the acceleration profiled of FIG. 5 and the controlled movement of mail/articles provided for example by the substantially friction-free mail-contacting surface of belt 34 are two important aspects of the invention, each of which individually provides enhanced singulation performance Together, these two features provide substantially enhanced performance of the singulator.

Other variations are also possible, and are within the contemplations of the invention, but are currently believed to be either less effective, more complicated, or both. Further, mechanisms can be used to detect pressure at the singulation head other than the projections 46T, 46B and the various supplemental vacuum heads 40, 42 and 44, while desirable, are not essential to the practicing of the invention. Finally, while a continuously perforated belt is considered preferable for optimum singulation and throughput, various pitched or other hole patterns are possible for belt 34, and may be useful in some applications. The belt hole pattern should generally correspond to any hole or slot pattern for the vacuum chambers. Thus, while the invention has been particularly shown and described above with reference to a preferred embodiment, the foregoing and other changes in form and detail may be made therein by one skilled in the art without departing from the spirit and scope of the invention which is to be defined only by the appended claims.

What is claimed is:

1. A singulation mechanism for use in a handling system for substantially flat articles including:

a singulation head to which a stack of said articles is fed, said head including a belt having a predetermined pattern of openings formed therein, which belt is driven across said head at a selected rate, and first and second vacuum chambers positioned behind said belt so as to apply vacuum therethrough when energized, with the fist vacuum chamber V1 tailing the second vacuum chamber V2, the belt therefore passing over V1 before V2, an article fed to the head being pressed against a surface of said belt opposite that passing over V1 and V2, the surface of said belt against which articles are pressed having a low coefficient of friction within a range of 0.20 to 0.32, as measured against that of paper, and including at least one of: polyester and polyteuoroethylene, such that absent vacuum applied through said belt from a vacuum chamber, the belt does not impart substantial movement to an article pressed against it;

a first detector for detecting when ah article being singulated by said head reaches a selected first point near a leading edge of said head;

a take-away mechanism for articles exiting said head;

a second detector for detecting the article reaching a selected second point of the take away mechanism; and controls for selectively energizing V1, for de-energizing V1 and for energized V2 in response to an output from said first detector, and for de-energizing V2 in response to an output from said second detector.

2. A mechanism as claimed in claim 1 wherein said vacuum chambers, when energized are at a vacuum pressure of approximately 10 Hg to 25 Hg depending at least in part on the selected weight range for said articles.

3. A mechanism as claimed in claim 2 wherein said articles have a maximum weight of approximately 6 lbs., and where said vacuum pressure range is approximately 15 Hg to 24 Hg.

4. A mechanism as claimed in claim 2 wherein the vacuum flow for said vacuum chambers is in a range of approximately 14 cfm to 17 cfm.

5. A mechanism as claimed in claim 1 wherein said controls also momentarily stop and restart said belt in response to an output from said first detector.

6. A mechanism as claimed in claim 1 including at least one pressure sensor on said head to detect the pressure at which articles are pressed against said surface of the belt.

7. A mechanism as claimed in claim 6 wherein there is at least one said pressure sensor below said belt and at least one said pressure sensor above said belt.

8. A mechanism as claimed in claim 1 including at least one low-pressure vacuum chamber trailing said belt to apply drag force to doubles.

9. A mechanism as claimed in claim 1 wherein said belt has a substantially vertical orientation with an upper edge and a lower edge, and including a low-pressure vacuum chamber adjacent at least one of the upper and lower edges of said belt to stabilize said articles and to apply drag force to doubles.

10. A mechanism as claimed in claim 1 wherein said articles are pieces of mail.

11. A mechanism as claimed in claim 10 including a vacuum doubles resolver head mounted over a travel path of mail between the singulation head and the take-away mechanism.

12. A mechanism as claimed in claim 11 wherein a double resolved by said doubles resolver head may get hung up between said singulation head and said take-away mechanism, said singulation mechanism including a detector which detects the presence of a piece of mail in between said head and said take-away mechanism, said controls being operative in response to an output from said detector after detection that a piece of mail being singulated has reached a predetermined position in the take-away mechanism for energizing V2 to move said doubled piece to the take-away mechanism.

13. A mechanism as claimed in claim 12 including at least one low pressure vacuum chamber above and/or below said belt, and wherein said controls are further operative in response to the detection of a piece of mail between said head and said take-away mechanism for diverting vacuum from said doubles resolver head to at least one said low pressure vacuum chamber.

14. A mechanism claimed in claim 10 wherein said belt is moved at approximately 78 to 85 in/sec and said take-away mechanism is moving at approximately 100 to 102 in/sec.

15. A singulation head for use in a handling system for substantially flat articles including:

a belt having a predetermined pattern of openings formed therein, which belt is driven across said head at a selected rate, said belt having a first side with a low coefficient of friction within a range of 0.20 to 0.32, as measured against that of paper, and including at least one of: polyester and polytetrafluoroethylene, against which said articles are pressed and a second side opposite said first side; and a source selectively applying low pressure to said second side of the belt when an article is to be moved by the belt, said belt being substantially ineffective to move an article pressed against said surface when low pressure is not applied thereto.

16. A head as claimed in claim 15 wherein said source is a vacuum source selectively applying vacuum to the second side of said belt.

17. A head as claimed in claim 15 wherein said articles are mixed mail, and wherein said belt is approximately 3" wide and continuously perforated.

18. A belt for use in a singulation head of a substantially flat article handling system including:

a first side having a substantially friction free surface with a coefficient of friction within a range of 0.20 to 0.32, as measured against that of paper, and including at least one of polyester and polytetluoroethylene, against which said articles are pressed, a second side opposite said first side to which said head selectively applies at least substantial vacuum pressure, and a pattern of openings formed in said belt between said first and second sides.

19. A belt as claimed in claim 18 wherein said articles are mixed mail, and wherein said belt is approximately 3" wide and continuously perforated.

20. A belt as claimed in claim 18 wherein said second side of the belt also has a low coefficient of friction.

* * * * *

UNITED STATES PATENT AND TRADEMARK OFFICE

CERTIFICATE OF CORRECTION

PATENT NO. : 6,443,444 B1
DATED : September 3, 2002
INVENTOR(S) : George Cera et al.

It is certified that error appears in the above-identified patent and that said Letters Patent is hereby corrected as shown below:

Title page,
Item [73], Assignee, please change "Lockhead" to -- Lockheed --.

Signed and Sealed this

Eleventh Day of February, 2003

JAMES E. ROGAN
*Director of the United States Patent and Trademark Office*